US010007212B2

(12) United States Patent
Shigehiro

(10) Patent No.: US 10,007,212 B2
(45) Date of Patent: Jun. 26, 2018

(54) DEVELOPING APPARATUS HAVING DEVELOPER GUIDING PORTIONS

(71) Applicant: CANON KABUSHIKI KAISHA, Tokyo (JP)

(72) Inventor: Koji Shigehiro, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/333,425

(22) Filed: Oct. 25, 2016

(65) Prior Publication Data

US 2017/0146927 A1 May 25, 2017

(30) Foreign Application Priority Data

Nov. 20, 2015 (JP) ..... 2015-227261

(51) Int. Cl.
*G03G 15/08* (2006.01)

(52) U.S. Cl.
CPC ..... *G03G 15/0893* (2013.01); *G03G 15/0889* (2013.01); *G03G 15/0891* (2013.01)

(58) Field of Classification Search
CPC ..... G03G 15/0889; G03G 15/0891; G03G 15/0893
USPC ..... 399/254
See application file for complete search history.

(56) References Cited

U.S. PATENT DOCUMENTS

| | | | | |
|---|---|---|---|---|
| 8,588,662 | B2 | 11/2013 | Kunihiro | |
| 2008/0008502 | A1* | 1/2008 | Hatakeyama | G03G 15/0844 399/254 |
| 2011/0217085 | A1* | 9/2011 | Hattori | G03G 15/09 399/254 |
| 2014/0112687 | A1* | 4/2014 | Ohmura | G03G 15/0893 399/254 |
| 2014/0129638 | A1 | 5/2014 | Joy et al. | |

FOREIGN PATENT DOCUMENTS

| | | | |
|---|---|---|---|
| JP | 2002-040774 | A | 2/2002 |
| JP | 2012-032488 | A | 2/2012 |
| JP | 2012-181485 | A | 9/2012 |
| JP | 2014-092934 | A | 5/2014 |

* cited by examiner

*Primary Examiner* — Billy Lactaoen
(74) *Attorney, Agent, or Firm* — Fitzpatrick, Cella, Harper & Scinto

(57) ABSTRACT

A developing apparatus includes a developer bearing member, a first chamber to supply the developer to the developer bearing member, and a second chamber to collect the developer having passed through a developing region. A guiding portion is arranged on a partition portion that separates the first and second chambers. The guiding portion guides the developer from the developer bearing member to the second chamber, and is positioned overlapping a communicating portion between the first and second chambers. One end portion of the guiding portion is arranged above an upper end of the partition portion, and the other end portion of the guiding portion is arranged above a rotation axis of a conveyance screw in the second chamber and below an uppermost portion of the conveyance screw while leaving a clearance between the guiding portion and the conveyance screw.

5 Claims, 11 Drawing Sheets

DEVELOPING APPARATUS HAVING DEVELOPER GUIDING PORTIONS

BACKGROUND OF THE INVENTION

Field of the Invention

The present invention relates to a developing apparatus provided in an electrophotographic or electrostatic-recording image forming apparatus.

Description of the Related Art

Developing apparatuses equipped with a developer container storing a two-component developer including carrier and toner and a developer sleeve, i.e., developer bearing member, bearing the developer and rotating, are used widely as the developing apparatus provided in an electrophotographic image forming apparatus. A developing sleeve rotates while bearing the developer stored in the developer container, and supplies toner to an image bearing member such as a photosensitive drum, to thereby develop an electrostatic latent image on the image bearing member as a toner image. As an example of such developing apparatus, a so-called functionally separated configuration is known, where the inner space of the developer container is divided by a partition into a first chamber for supplying developer to a developer bearing member and a second chamber in which the developer used for developing an image is recovered from the developing sleeve.

Japanese Patent Laid-Open No. 2012-032488 discloses a functionally separated developing apparatus that includes a developing tank in which a first conveyance path, i.e., first chamber, and a second conveyance path, i.e., second chamber, are formed, and a slide member constituting a slope along which developer having fallen from the developing sleeve falls into the second conveyance path. In this developing apparatus, the first conveyance path and the second conveyance path are arranged side by side in a horizontal direction, and separated by a separating wall, i.e., partition wall, extending upward from a bottom portion of the tank. The slide member is disposed above the partition wall, and the developer having fallen from the developing sleeve slides down on the slope of the slide member and is recovered to the second conveyance path.

According to the functionally separated configuration, the developer recovered from the developing sleeve is sequentially added to the developer being conveyed in the second chamber, so that in the second chamber, the developer surface tends to be raised toward the downstream side in the second chamber in the conveyance direction of the developer. Therefore, the agitation of the developer near the surface layer is not easily promoted at the downstream portion of the second chamber. Generally, a conveyance member such as a screw that agitates and conveys the developer by rotation is arranged in the second chamber. The developer positioned above a rotation trajectory of the conveyance member could not be easily drawn to the inner side of the rotation trajectory even when the conveyance member is rotated, and tended to stay in a vicinity of the surface layer.

According to the developing apparatus disclosed in Japanese Patent Laid-Open No. 2012-032488, a communication path, i.e., transfer portion, through which the developer in the second conveyance path is transferred to the first conveyance path, is formed in a downstream part of the partition wall in the conveyance direction of the second conveyance path. Further, a configuration is adopted where a portion of the developer recovered via the slide member (hereinafter referred to as a recovered developer) falls to a position overlapped with the communication path. As a result of this configuration, however, the recovered developer having a low toner density after supplying toner to the image bearing member falls near the communication path having a high developer surface. Therefore, a portion of the recovered developer may move in floating motion on the surface layer of the developer, and flow into the first conveyance path in a state not sufficiently agitated with the surrounding developer. Thus, the developer becoming heterogeneous by the recovered developer may be borne on the developing sleeve and used for developing images, which may cause unevenness of density or other image defects.

SUMMARY OF THE INVENTION

The present invention provides a developing apparatus that promotes agitation of the developer recovered from the developer bearing member and maintains the image quality.

According to an aspect of the present invention, a developing apparatus includes a developer bearing member configured to rotate while bearing developer, a developer container including a first chamber from which the developer is supplied to the developer bearing member, a second chamber configured to form a circulation path of the developer with the first chamber, and a partition portion arranged to separate the first chamber and the second chamber from each other, a first conveyance member arranged in the first chamber and configured to convey the developer while agitating the developer, a second conveyance member arranged in the second chamber such that at least a portion of the second conveyance member is overlapped with the first conveyance member in a state viewed from a horizontal direction, the second conveyance member being configured to convey the developer while agitating the developer, a transfer portion provided in a downstream part of the partition portion in a conveyance direction of the second conveyance member and defining an opening through which the developer within the second chamber is transferred to the first chamber, and an extended portion provided on the partition portion at a position overlapped with the transfer portion in the conveyance direction and arranged to extend in a direction toward the second chamber from the developer bearing member such that an end portion of the extended portion is positioned above the second conveyance member within the second chamber.

Further features of the present invention will become apparent from the following description of exemplary embodiments with reference to the attached drawings.

DESCRIPTION OF THE EMBODIMENTS

Now, a developing apparatus according to the present disclosure and an image forming apparatus equipped with the developing apparatus will be described with reference to the drawings.

First Embodiment

Figure 1:
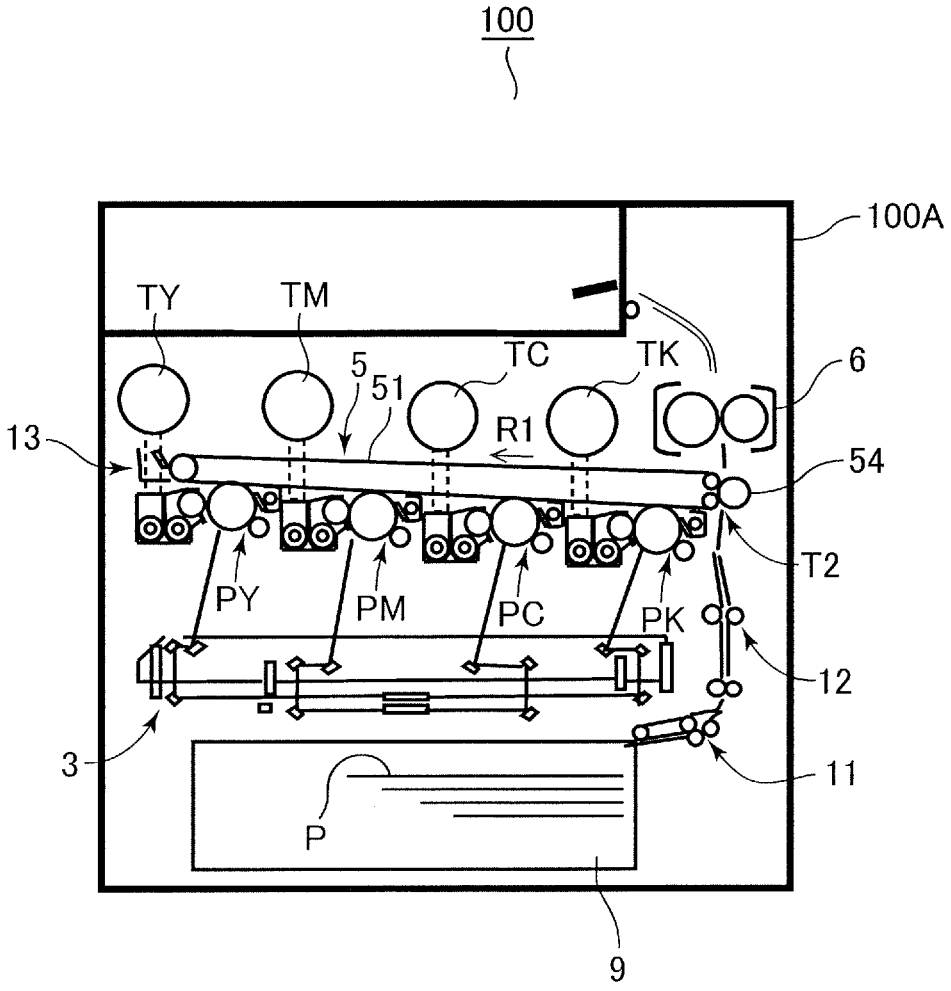
FIG. 1 is a schematic configuration diagram illustrating an image forming apparatus according to the first embodiment.

An image forming apparatus 100 according to the first embodiment will be described. The image forming apparatus 100, as illustrated in schematic view in FIG. 1, is an electrophotographic image forming apparatus having image forming units PY, PM, PC and PK configured to form toner images of respective colors of yellow (Y), magenta (M), cyan (C) and black (K). The image forming apparatus 100 forms an image on a recording material P according to an image information input from a document reading apparatus, serving as a reader, connected to an apparatus body 100A, or input from a host device such as a personal computer, serving as an external PC, connected to the apparatus body 100A.

The image forming apparatus 100 includes a transfer device 5 having an intermediate transfer belt 51, serving as an intermediate transfer body, rotationally driven in a predetermined direction R1 by a driving unit not illustrated. The image forming apparatus 100 is a so-called four-unit tandem-type image forming apparatus where four image forming units PY through PK are arranged along a direction of rotation of the intermediate transfer belt 51. The toner images formed in the respective image forming units PY through PK are transferred in multiple layers by superposing the images sequentially on the surface of the intermediate transfer belt 51. The formed full-color toner image formed in this manner is transferred to the recording material P at a secondary transfer portion T2 formed as a nip portion between the intermediate transfer belt 51 and a secondary transfer roller 54.

In addition, the image forming apparatus 100 includes a sheet feed cassette 9, a sheet feeding apparatus 11, a registration roller pair 12, a fixing unit 6, and so on. Recording materials P are supported on the sheet feed cassette 9 that can be attached to and detached from the apparatus body 100A. Paper such as printing paper, plastic sheets such as OHP films, cloth and so on can be used as the recording material P, serving as a recording medium. The sheet feeding apparatus 11 includes a pickup roller that draws out the recording material P supported on the sheet feed cassette 9 and a conveyance roller receiving the recording material P from the pickup roller and conveying the material P, and the sheet feeding apparatus 11 separates the recording materials P one at a time and conveys the material P toward the registration roller pair 12. The registration roller pair 12 abuts against a leading edge portion of the recording material P, corrects skew feed of the recording material P, and sends out the recording material P to the secondary transfer portion T2 at a matched timing as the transfer of the toner image at the secondary transfer portion T2. The fixing unit 6 has a roller pair that nips and conveys the recording material P, and the toner is melted and mixed and the image is fixed to the recording material P by applying pressure and heat to the recording material P to which the toner image has been transferred. The recording material P to which the image has been fixed is discharged to a discharge tray provided at an upper portion of a casing of the apparatus body 100A.

Image Forming Unit

Figure 2:
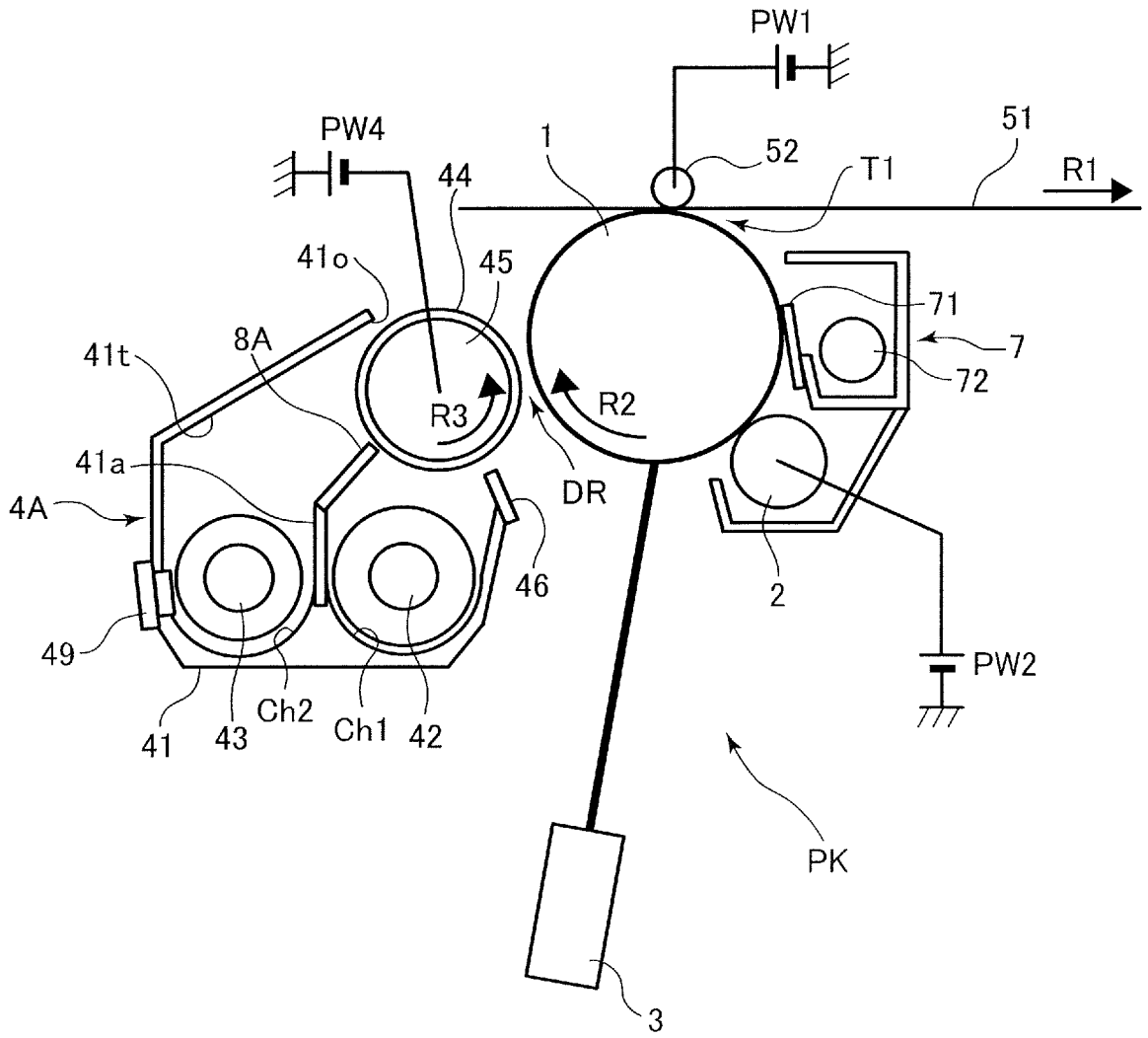
FIG. 2 is a front view illustrating an image forming unit according to the first embodiment.

Next, the image forming units PY, PM, PC and PK will be described with reference to FIG. 2. It is noted that the configurations of the respective image forming units PY, PM, PC and PK are basically the same, except for the different toner colors used for developing the images. Therefore, the configuration of the image forming unit will be descried taking a black image forming unit PK as an example, but it should be assumed that the other image forming units PY, PM and PC are configured similarly.

The image forming unit PK includes a photosensitive drum 1, a charging roller 2, a developing apparatus 4A, and a cleaning unit 7. An exposing unit 3, serving as a laser-exposing optical system arranged below the image forming units PY through PK, is configured to irradiate the photosensitive drums 1 of the respective image forming units PY through PK with laser beams. The photosensitive drum 1, serving as a drum-shaped photoconductor, is driven to rotate in a direction (direction of arrow R2) along a direction of rotation of the intermediate transfer belt 51 by a driving device not shown. The charging roller 2, an exposure region of the exposing unit 3, the developing apparatus 4A and the cleaning unit 7 are arranged sequentially along the direction of rotation of the photosensitive drum 1.

The charging roller 2, serving as a charging device, is connected to a charging bias power supply PW2, and charges the surface of the photosensitive drum 1 uniformly. The exposing unit 3 scans the surface of the photosensitive drum 1, using a polygon mirror and the like, with the laser beam that is irradiated from a light emitting component for example and modulated based on the image information. Thus, the photosensitive drum 1, serving as an image bearing member configured to bear an electrostatic latent image and a toner image, is exposed, and an electrostatic latent image is formed on the surface of the photosensitive drum 1. The developing apparatus 4A described later executes an image developing step of supplying toner to the photosensitive drum 1 and developing the electrostatic latent image as a toner image.

The transfer device 5 includes a primary transfer roller 52, serving as a primary transfer member, pressed against the photosensitive drum 1 with the intermediate transfer belt 51 interposed. The primary transfer roller 52 is connected to a primary transfer bias power supply PW1 that applies primary transfer bias voltage to the roller, and forms a potential gradient to a primary transfer portion T1 formed as a nip portion between the photosensitive drum 1 and the intermediate transfer belt 51. A toner image borne on the photosensitive drum 1 is subjected to primary transfer to the intermediate transfer belt 51 by the operation of the primary transfer bias voltage, and superposed on the toner images formed by the upstream image forming units PY, PM and PC.

The cleaning unit 7 has a cleaning blade 71 that abuts against the photosensitive drum 1 at a position downstream of the primary transfer portion T1, and scrapes off toner and other attached substances remaining on the surface of the photosensitive drum 1 having passed the primary transfer portion T1. The attached substances scraped off by the cleaning blade 71 are conveyed by a conveyance screw 72, and collected into a collection container provided in the apparatus body 100A. Further, the toner and other attached substances residing on the intermediate transfer belt 51 having passed the secondary transfer portion T2 are removed by an intermediate transfer body cleaner 13 (refer to FIG. 1) and collected into the collection container.

In the above description, an example has been illustrated where the image forming apparatus 100 forms a full-color image, but it is also possible to form a single-color or multiple-color image by activating an arbitrary combination of the four image forming units PY through PK. For example, the image forming apparatus 100 can form a monochrome image on the recording material P by activating only the black image forming unit PK.

Developing Apparatus

Next, we will illustrate the developing apparatus 4A according to the present embodiment. The developing apparatus 4A is an apparatus executing an image developing step using a so-called two-component developer containing non-magnetic toner particles (hereinafter referred to as toner) and magnetic carrier particles (hereinafter referred to as carrier). As illustrated in FIG. 2, the developing apparatus 4A includes a developer container 41, a developing sleeve 44, a magnet roll 45, a developing blade 46, a toner density sensor 49, and so on. An interior of the developer container 41 storing the developer is divided into a development chamber Ch1 and an agitation chamber Ch2 by a partition portion 41*a* rising from a bottom portion of the container and an inclined portion 8A supported on the partition portion 41*a*. The developing apparatus 4A is a so-called functionally separated developing apparatus that supplies developer to the developing sleeve 44 from the development chamber Ch1, serving as a first chamber, and recovering the developer used for developing the image to the agitation chamber Ch2, serving as a second chamber.

An opening portion 410 in which the magnet roll 45 and the developing sleeve 44 are arranged is formed on the developer container 41 so as to face the photosensitive drum 1. The magnet roll 45, serving as a magnetic field generating unit, has a plurality of magnetic poles arranged at predetermined positions in the circumferential direction, and is fixed to the developer container 41. The developing sleeve 44, serving as a developer bearing member bearing the developer, is a cylindrical member externally fit to the magnet roll 45. The developing sleeve 44 is disposed rotatably in a direction (direction of arrow R3) along the direction of rotation of the photosensitive drum 1, and forms a development region DR as a gap between the photosensitive drum 1. Further, the developing sleeve 44 is connected to a developing bias power supply PW4 that applies a developing bias voltage where AC voltage is superposed to a DC voltage having a same polarity as a charged polarity of toner. Further, the developing blade 46, serving as a regulating member arranged in proximity to an outer circumferential surface of the developing sleeve 44, is provided under the opening portion 41*o*.

Figure 3A:
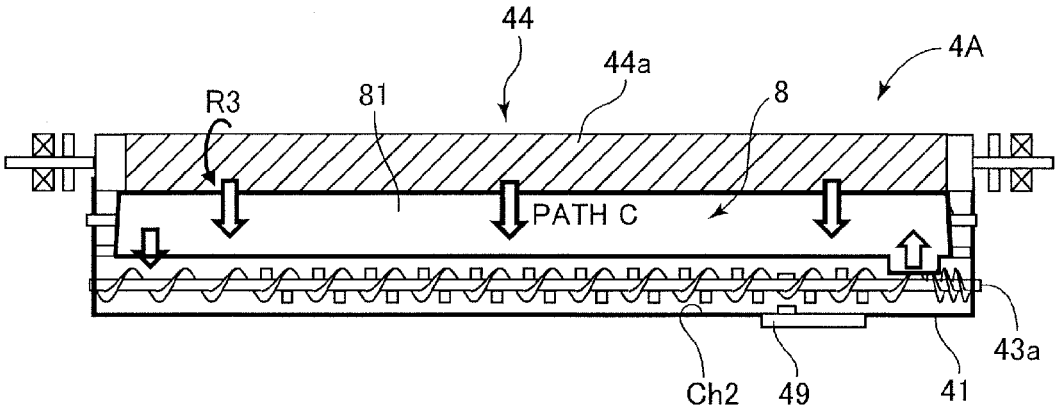
FIG. 3A is an upper view illustrating a developing apparatus according to the first embodiment.
Figure 3B:
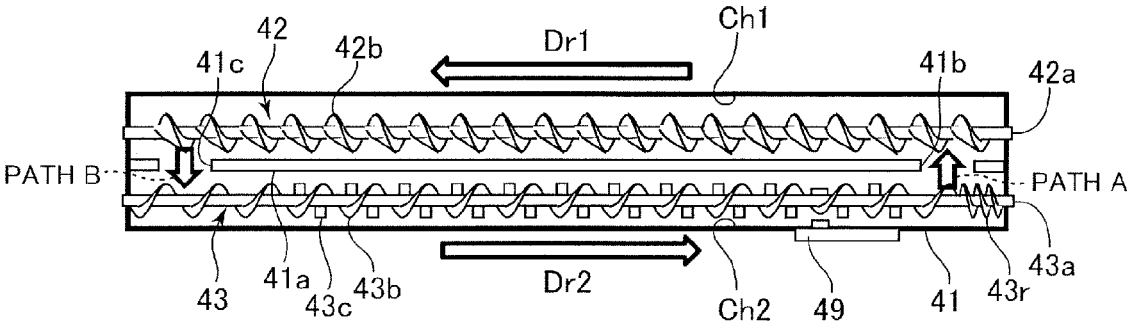
FIG. 3B is an upper view illustrating the developing apparatus in a state where a developing sleeve and an inclined portion are removed.
Figure 3C:
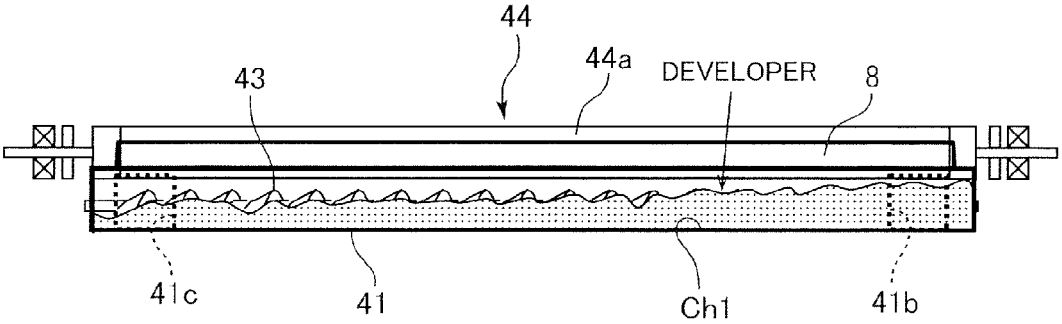
FIG. 3C is a side view illustrating the developing apparatus from a side having an agitation chamber.

As illustrated in FIGS. 3A through 3C, the developing apparatus 4A has a shape extended longitudinally in an axial direction of the developing sleeve 44 arranged in parallel with the photosensitive drum 1. Hereinafter, the axial direction of the developing sleeve 44 is referred to as a "longitudinal direction". FIGS. 3A and 3B are views illustrating the developing apparatus 4A from above, wherein FIG. 3A illustrates a state where a top plate portion 41*t* of the developer container 41 is removed (refer to FIG. 2), and FIG. 3B illustrates a state where the developing sleeve 44 and the inclined portion 8A are further removed. FIG. 3C is a view illustrating the developing apparatus 4A from a horizontal direction, i.e., from the lower side of FIG. 3A.

As illustrated in FIG. 3B, a first screw 42 and a second screw 43, which are screws having axial center portions arranged in the longitudinal direction, are respectively arranged in the development chamber Ch1 and the agitation chamber Ch2 as conveyance members that convey the developer while agitating the developer. The first screw 42, serving as the first conveyance member, includes a shaft portion 42*a* formed of a magnetic substance, and a blade portion 42*b*, serving as a conveyance portion, disposed spirally around the shaft portion 42*a*. The second screw 43, serving as a second conveyance member, includes a shaft portion 43*a* formed of a magnetic substance, a blade portion 43*b*, serving as a conveyance portion, disposed spirally around the shaft portion 43*a*, and agitating ribs 43*c* protruding outward in a radial direction from the shaft portion 43*a* with a predetermined width in the axial direction between the pitches of the blade portion 43*b*. Further, a reverse conveyance portion 43*r* formed in a spiral shape in the opposite direction as the blade portion 43*b* is provided on a downstream end portion of the second screw 43. The first screw 42 and the second screw 43 are respectively driven to rotate by connecting to respective driving units not shown. The first screw 42 conveys the developer within the development chamber Ch1 to one longitudinal direction while agitating the developer (an arrow Dr1 of FIG. 3B), and the second screw 43 conveys the developer within the agitation chamber Ch2 to the other longitudinal direction while agitating the developer (an arrow Dr2 of FIG. 3B).

As illustrated in FIGS. 3B and 3C, transfer portions 41*b* and 41*c* that communicate the development chamber Ch1 and the agitation chamber Ch2 are formed at both ends in the longitudinal direction of the partition portion 41*a*. The transfer portion 41*b* formed at a downstream position of the agitation chamber Ch2 in the conveyance direction of the second screw 43 serves as a path, i.e., path A, through which the developer stored in the agitation chamber Ch2 is transferred to the upstream portion of the development chamber Ch1. The other transfer portion 41*c* is formed at a downstream position of the development chamber Ch1 in the conveyance direction of the first screw 42, i.e., the upstream position of the agitation chamber Ch2, and serves as a path, i.e., path B, through which the developer stored in the development chamber Ch1 is transferred to the upstream portion of the agitation chamber Ch2. Therefore, the development chamber Ch1 and the agitation chamber Ch2 mutually communicated via the transfer portions 41*b* and 41*c* form a circulation path through which the developer is conveyed in circulation within the developer container 41.

A longitudinal width of the development chamber Ch1 and the agitation chamber Ch2, i.e., width of the developer container 41, is set to a length having added an arbitrary margin to both sides in the longitudinal direction with respect to a coated area 44*a* of the developing sleeve 44 (refer to FIG. 3A), and it is substantially equal to an overall length of the developing sleeve 44. The coated area refers to an area where developer is borne on a surface of the developing sleeve 44 in a form of a thin layer by an action of the magnetic field generated by the magnet roll 45. Then, the transfer portions 41*b* and 41*c* are substantially formed at positions overlapped in the longitudinal direction with the coated area 44*a*. According to this configuration, the developing apparatus can be downsized in the longitudinal direction, and the required amount of carries within the developer container 41 can be cut down, according to which the reduction of costs can be realized.

Now, the arrangement of the development chamber Ch1 and the agitation chamber Ch2, and the configuration for recovering the developer will be described. As illustrated in FIG. 2, the first screw 42 and the second screw 43 are arranged such that at least a portion of the screws are overlapped when viewed from the horizontal direction, and in the present embodiment, the screws are arranged approximately horizontally. However, the first and second screws 42 and 43 can be arranged at different positions in the vertical direction within an area where they are partially overlapped when viewed from the horizontal direction. The development chamber Ch1 and the agitation chamber Ch2 are arranged so that the bottom portions are respectively aligned approximately horizontally, and the chambers are divided by a partition portion 41*a* erected upward from a bottom portion of the developer container 41 and extending in the vertical direction. The developing sleeve 44 is arranged on the side of the development chamber Ch1 with respect to the partition portion 41*a* in the horizontal direction, and positioned above the first screw 42.

Figure 4:
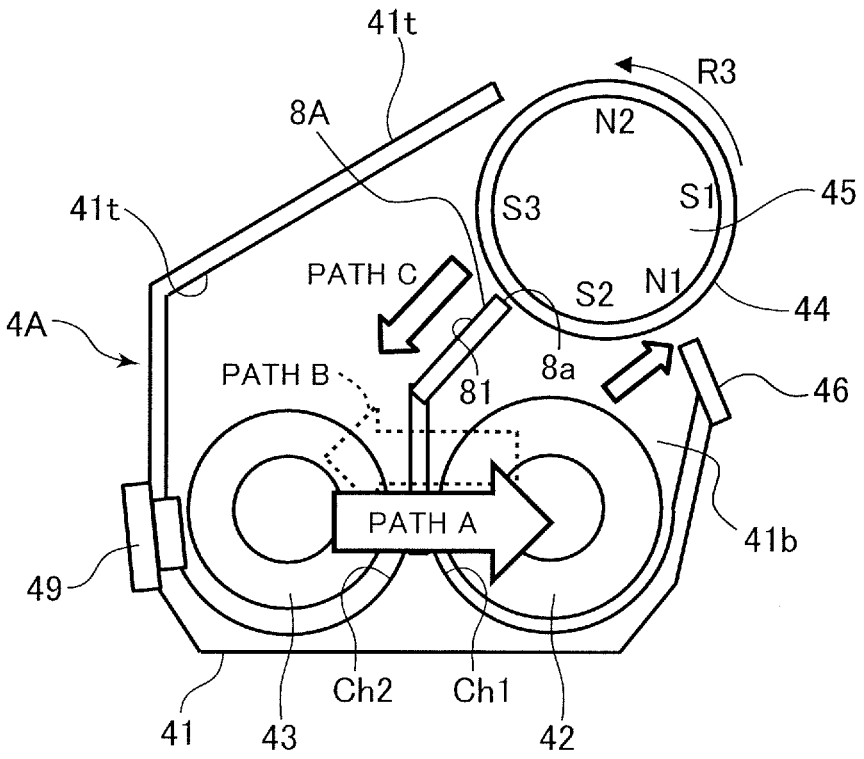
FIG. 4 is a cross-sectional view illustrating the developing apparatus according to the first embodiment.

As illustrated in FIG. 4, the inclined portion 8A, serving as a recovery member to recover the developer borne on the developing sleeve 44 into the agitation chamber Ch2, is formed integrally with the partition portion 41*a*. The inclined portion 8A has an inclined plane 81 inclined from an upper portion of the partition portion 41*a* in a horizontal direction moving away from the agitation chamber Ch2 (right direction in the drawing) and extending upward, and the inclined portion 8A approximates the developing sleeve 44 at an upper edge 8*a* of the inclined plane. In other words, the inclined portion 8A extends from the upper portion of the partition portion 41*a* toward a direction approximating the developing sleeve 44, and divides the upper space in the developer container 41 into the development chamber Ch1 and the agitation chamber Ch2.

The magnet roll 45 has a magnetic pole S2, serving as a pump-up pole, facing the development chamber Ch1, and a magnetic pole S3, serving as a repulsing pole, having the same polarity and arranged on the other side of the magnetic pole S2 with respect to the inclined portion 8A in the circumferential direction. That is, the magnet roll 45 is configured so that the developer falls off from the developing sleeve 44 in a vicinity of the inclined portion 8A by the repulsive magnetic field formed by these magnetic poles S2 and S3. The inclined plane 81 is extended to a position where the upper edge 8*a* is at a position approximating an outer circumferential surface of the developing sleeve 44 at a predetermined distance. The predetermined distance is a distance set so that the developer having fallen from the surface of the developing sleeve 44 is received by the inclined plane and prevented from mixing into the development chamber Ch1. Therefore, the inclined plane 81 of the inclined portion 8A constitutes a recovery path, i.e., path C, through which the developer having fallen from the developing sleeve 44 is recovered into the agitation chamber Ch2.

A supply port connected to a toner hopper (not shown) of the apparatus body 100A is formed at a most upstream position of the agitation chamber Ch2 on the top plate portion 41*t* of the developer container 41. The toner hopper temporarily stores toners of respective colors, or supplying developers in which the toners and carrier are mixed with a toner-rich ratio, discharged from toner bottles TY, TM, TC and TK (refer to FIG. 1). Thereafter, a control unit (not shown) provided in the apparatus body 100A executes an automatic toner supply control where the supply screw disposed in the toner hopper is driven to control the amount of toner supplied to the developer container 41.

The automatic toner supply control is executed based, for example, on detection signals from the toner density sensor 49, patch image density signals, and video count signals. The toner density sensor 49 is an inductance sensor capable of measuring the toner density of the developer (T/D ratio: ratio of weight of the toner with respect to the total weight of the developer) contained in the developer container 41 by detecting magnetic permeability. A video count signal is a signal having added the color densities of the respective pixels (color ratio of the image) acquired when a printer controller 300 reads the image information input from a host device, and the signal is used to predict the amount of toner consumption. Further, a patch density sensor (not shown) capable of measuring the density of patch images formed on the intermediate transfer belt 51 by the respective image forming units PY through PK is provided in the apparatus body 100A. The control unit estimates a charged amount of toner in the developing apparatus 4A based on the detection signal from the patch density sensor. Based on these signals, the control unit of the apparatus body 100A controls the amount of rotation of the supply screw so that the controlled quantities, such as the amount of developer in the developer container 41, the toner density and the charged amount of the toner, fall within a predetermined appropriate range.

Circulation Conveyance of Developer

A toner feeding operation from the developing apparatus 4A configured as above to the photosensitive drum 1 and a circulation conveyance operation of the developer will be described with reference to FIGS. 3A through 4. The developing apparatus 4A is activated when the developing sleeve 44, the first screw 42 and the second screw 43 are started to be driven, for example, in a state where the image forming unit PK (PY, PM, PC) starts forming an image, i.e., image forming operation. In a state where the developing apparatus 4A is activated, the conveyance of the developer between the development chamber Ch1 and the agitation chamber Ch2 is started by the first screw 42 and the second screw 43 (refer to FIG. 3B). Along with this operation, the developer is agitated by the blade portions 42*b* and 43*b* and the agitating ribs 43*c* on the first and second screws 42 and 43, by which the toner and carrier are electrostatically bonded through frictional charge.

As illustrated in FIG. 4, the developer transferred from the agitation chamber Ch2 to the development chamber Ch1 via the transfer portion 41*b*, i.e., path A, forms a developer pile around the developing sleeve 44, and the developer is attracted by the magnetic field generated by the magnet roll 45 and borne on the developing sleeve 44. The developer borne on the developing sleeve 44 is moved along with the rotation of the developing sleeve 44, and after the layer thickness of the developer has been regulated by the developing blade 46, the developer reaches the development region DR outside the developer container 41. The developer having reached the development region DR forms chain-like magnetic bristles, i.e., naps of developer, by the operation of a magnetic pole S1, serving as a development pole, arranged adjacent to the development region DR. Then, the toner is supplied to the photosensitive drum 1 such that the toner transfers to the photosensitive drum 1 resisting the adhesion force with the carrier under a bias electric field formed by the developing bias voltage and the electrostatic latent image on the photosensitive drum 1. Thereby, the electrostatic latent image on the photosensitive drum 1 is developed, and the image developing step in the image forming unit PK (PY, PM, PC) is completed.

The developer in a carrier-rich state in which the toner has been consumed is carried to the inner side of the developer container 41 again by the rotation of the developing sleeve 44, and falls from the surface of the developing sleeve 44 by the operation of the magnetic poles S2 and S3. The developer having dropped from the developing sleeve 44 slides down the inclined plane 81, i.e., path C, of the inclined portion 8A, and is recovered into the agitation chamber Ch2. The developer having been conveyed to the downstream portion of the development chamber Ch1 by the first screw 43 without being borne on the developing sleeve 44 is transferred via the transfer portion 41*c*, i.e., path B, to the agitation chamber Ch2.

The developer having been sent into the development chamber Ch1 via the path A within the developer container 41 is returned to the agitation chamber Ch2 via either the path B or the path C. The toner having been supplied from the toner hopper is supplied to a position of a supply port provided on the most upstream portion of the agitation chamber Ch2. Accordingly, while the development chamber Ch1 is provided with a function of supplying the developer to the developing sleeve 44, the agitation chamber Ch2 bears the function of agitating the developer flowing into the chamber via a plurality of paths including the recovery path, i.e., path C, from the developing sleeve 44, and sending the developer into the development chamber Ch1 in a homogenized state. According to such functionally separated configuration, the homogeneity of the developer borne on the developing sleeve 44 can be improved and the quality of the image can be improved, compared to a configuration where the developer recovered from the developing sleeve 44 is returned to the development chamber Ch1.

Behavior of Recovered Developer

Next, a problem that may be caused by the developer being recovered from the developing sleeve 44 in the functionally separated configuration will be described, with reference to a developing apparatus 4Z serving as a comparative example. Here, it is assumed that the developing apparatus 4Z constitutes a portion of the image forming unit configured similarly as the above-described image forming units PY through PK, and the components having a similar configuration and function as the developing apparatus 4A according to the present embodiment will be denoted with the same reference numbers, and descriptions thereof are omitted. Further, for sake of description, the developer having fallen from the developing sleeve 44 to the inclined plane 81 of an inclined portion 8Z is referred hereinafter as a "recovered developer".

Figure 5A:
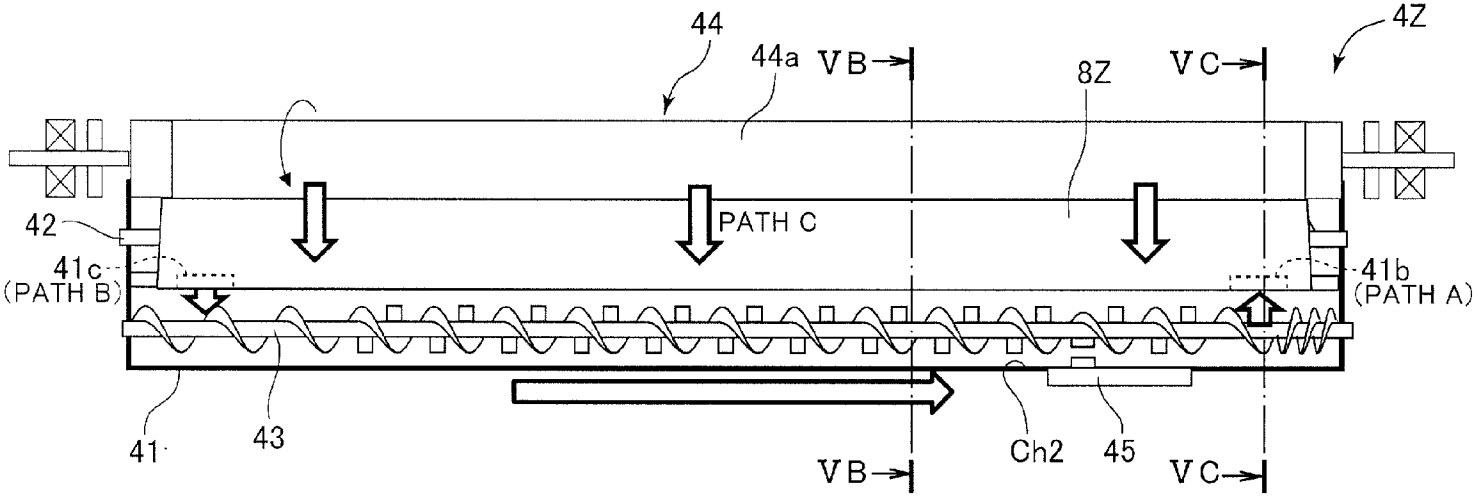
FIG. 5A is an upper view illustrating the developing apparatus of a comparative example.
Figure 5C:
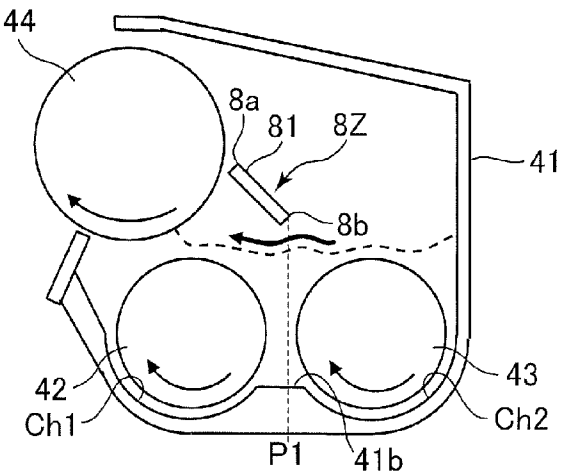
FIG. 5C is a cross-sectional view taken at another position illustrated in FIG. 5A.
Figure 5B:
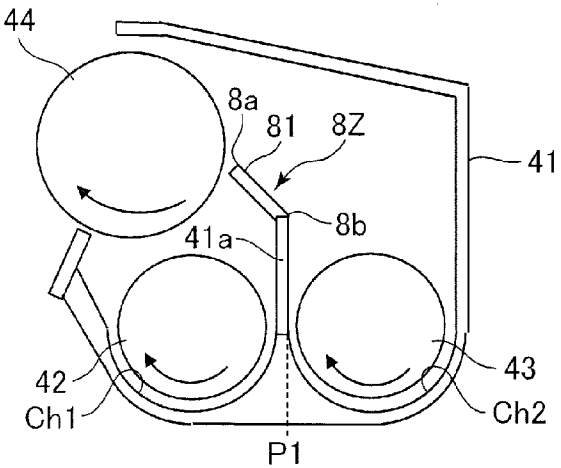
FIG. 5B is a cross-sectional view taken at a position illustrated in FIG. 5A.

As illustrated in FIGS. 5A and 5B, the development chamber Ch1 in which the first screw 42 is provided and the agitation chamber Ch2 in which the second screw 43 is provided are formed in the developer container 41 of the developing apparatus 4Z, and the two chambers are communicated via transfer portions 41*b* and 41*c*. Further, the inclined portion 8Z recovering the developer borne on the developing sleeve 44 to the agitation chamber Ch2 is provided inside the developer container 41. Similar to the above-described developing apparatus 4A, the developer stored in the developer container 41 is conveyed in circulation between the development chamber Ch1 and the agitation chamber Ch2. That is, the developer stored in the agitation chamber Ch2 is sent into the development chamber Ch1 via the transfer portion 41*b*, i.e., path A, and returned to the agitation chamber Ch2 via the transfer portion 41*c*, i.e., path B. Moreover, the developer having passed the development region DR accompanying the rotation of the developing sleeve 44 is recovered into the agitation chamber Ch2 via the inclined portion 8Z, i.e., path C.

Now, we will describe the shape of the inclined portion 8Z. As illustrated in FIG. 5B, the inclined portion 8Z is formed to bend from the upper end portion of the partition portion 41*a* toward the developing sleeve 44 in the position between the transfer portions 41*b* and 41*c* in the direction of conveyance of the second screw 43. Therefore, a lower edge 8*b* of the inclined plane 81 of the inclined portion 8Z is at an agitation chamber-side wall surface position P1 of the partition portion 41*a* in the horizontal direction when viewed from an axial direction of the developing sleeve 44. Conventionally, as illustrated in FIG. 5C, the inclined portion 8Z has a similar shape as the upstream side, at a position overlapped with the transfer portion 41*b* in the direction of conveyance of the second screw 43. That is, the lower edge 8*b* of the inclined plane 81 was arranged at the agitation chamber-side wall surface position P1 of the partition portion 41*a*.

In the developing apparatus 4Z, the recovered developer being dropped onto the inclined plane 81 slides down the inclined plane 81 in a direction approximately orthogonal to an axial direction of the second screw 43. Then, the recovered developer having reached the lower edge 8*b* of the inclined plane 81 drops into the agitation chamber Ch2 by gravity, and is conveyed downstream while being agitated by the second screw 43. Thus, the recovered developer having been recovered in the agitation chamber Ch2 is sequentially agitated and mixed with the developer conveyed from the upstream side, and is conveyed in the longitudinal direction.

By the way, according to the configuration where the recovered developer is sequentially recovered into the agitation chamber Ch2 via the inclined portion 8Z, the developer plane in the agitation chamber Ch2 tends to be raised toward the downstream area in the direction of conveyance of the second screw 43. In a state where the developer surface is high, the developer in the area above the rotation trajectory, i.e., radius of rotation, of the blade portion 43*b* has a deteriorated following property to the rotation of the blade portion 43*b*. Since the developer is a powder, a shear plane of the developer is formed along an outer circumferential portion of the rotation trajectory of the blade portion 43*b*, and the force conducted to the developer on the outer circumference side with respect to the center axis of the blade portion 43*b* is reduced significantly with the shear plane serving as the boundary.

Especially when the height position of the developer surface becomes higher than a vertex position of the blade portion 43*b* of the second screw 43 (refer to FIG. 3C), the developer on the surface layer becomes even less likely to be drawn into the rotation trajectory of the blade portion 43*b*, and the tendency of the developer to remain near the surface layer is increased. As a result, in the downstream portion of the agitation chamber Ch2 having a higher developer surface compared to the upstream portion, the recovered developer moved in a floating manner dispersed on the surface layer of the developer, and flows into the development chamber Ch1.

The recovered developer used during the image developing step is in a carrier-rich state where the toner density is low compared to the developer stored in the developer container 41, so that the toner density near the surface layer of the developer will be deteriorated if the recovered developer falls into the development chamber. If the recovered developer having fallen near the transfer portion 41*b* flows into the development chamber Ch1 in an insufficiently agitated state by the above-described process, there is a possibility that the developer having a heterogeneous toner density is borne on the developing sleeve 44. In that case, an area where the toner density is low compared to adjacent areas may be formed at a portion of the toner image, and there is fear that unevenness of density or other image defects may occur.

Detailed Configuration of Recovery Plate

Figure 6A:
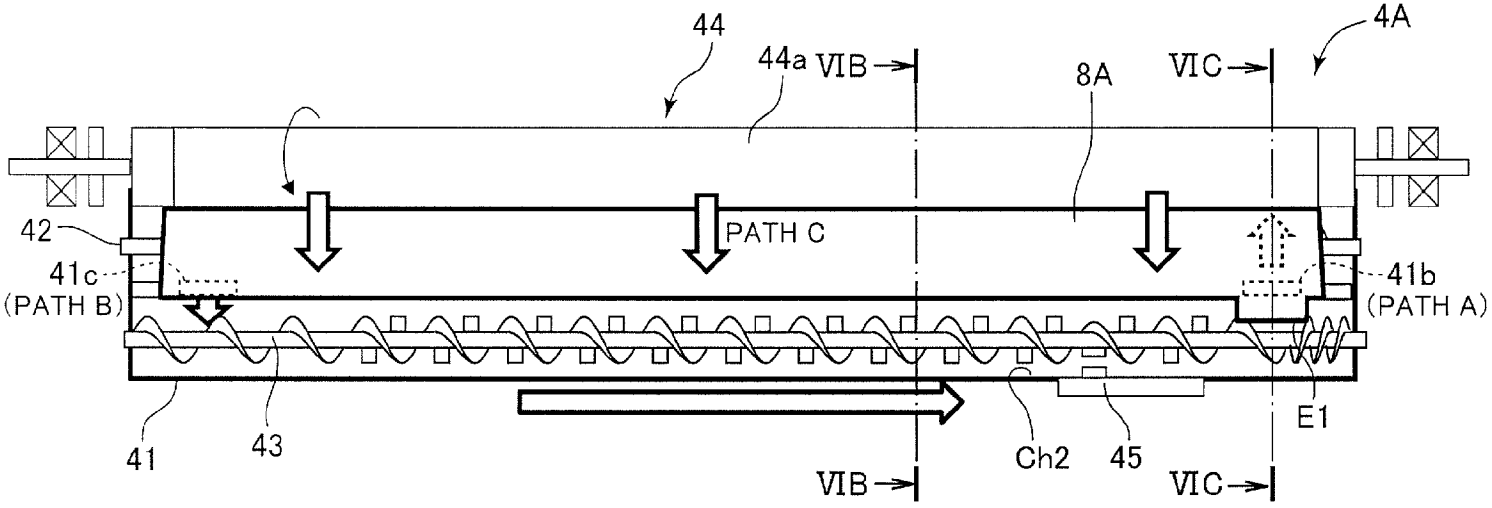
FIG. 6A is an upper view illustrating a developing apparatus according to the first embodiment.
Figure 6C:
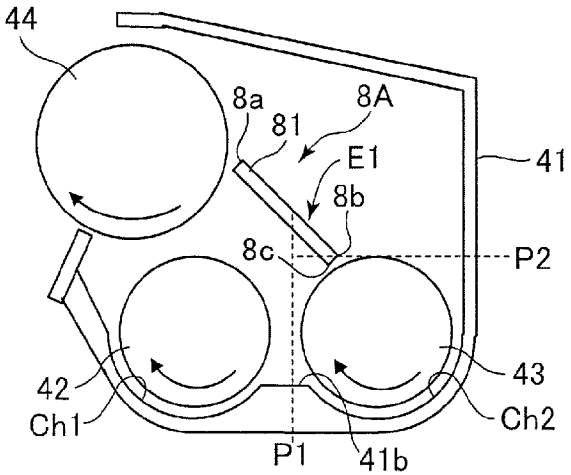
FIG. 6C is a cross-sectional view taken at another position illustrated in FIG. 6A.
Figure 6B:
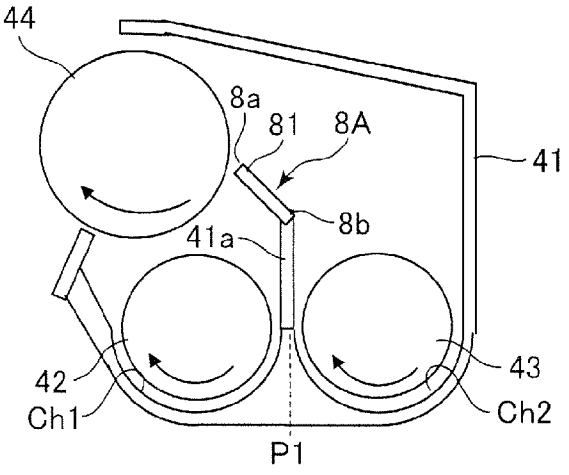
FIG. 6B is a cross-sectional view taken at a position illustrated in FIG. 6A.

Now, an extended portion E1 is provided to the inclined portion 8A of the developing apparatus 4A according to the present embodiment. Now, a detailed configuration of the inclined portion 8A will be described with reference to FIGS. 6A, 6B, and 6C. It is noted that FIG. 6A is an upper view illustrating the developing apparatus 4A in a state where the top plate portion 41*t* of the developer container 41 is removed. FIG. 6B and FIG. 6C are cross-sectional views of the developing apparatus 4A taken respectively at line VIB-VIB and line VIC-VIC of FIG. 6A.

As illustrated in FIG. 6B, similar to the developing apparatus 4Z of the comparative example, the inclined portion 8A is formed to bend toward the upper end portion of the developing sleeve 44 of the partition portion 41*a* at the position between the transfer portions 41*b* and 41*c* in the direction of conveyance of the second screw 43. On the other hand, as illustrated in FIG. 6C, the inclined portion 8A is protruded toward the agitation chamber Ch2 with respect to the partition portion 41*a* at a position overlapped with the transfer portion 41*b* in the direction of conveyance of the second screw 43. In other words, the inclined portion 8A has the inclined plane 81 extended at the position of the transfer portion 41*b*, and has the extended portion E1 protrude toward the agitation chamber Ch2 with respect to the agitation chamber-side wall surface position P1 of the partition portion 41*a*.

The shape of the extended portion E1 will be described. The extended portion E1 is a plate member formed to be inclined continuously with the inclined plane 81, at an equivalent angle as the inclination angle of the inclined plane 81 with respect to a horizontal plane. Therefore, the extended portion E1 extends lower than an upper end portion of the partition portion 41*a*, that is, below an intersection position of a dashed line of the wall surface position P1 and the inclined plane 81. Further, the extended portion E1 extends to a position overlapped with the second screw 43 when viewed from the vertical direction, and the lower edge 8*b*, i.e., an end portion of the extended portion, of the inclined plane 81 is configured to be positioned between the partition portion 41*a* and the rotational axis of the second screw 43.

The extended portion E1 is extended to a position lower than the developer surface in a state where a predetermined amount of developer is stored in the developer container 41 and the developing apparatus 4A is in a continuously operated state. Here, the predetermined amount refers to the amount of developer within a proper range of the developing apparatus 4A, and for example, it is an amount of developer set as a target of the above-described automatic toner supply control. Further, a state in which the developing apparatus 4A is in a continuously operated state refers to a state where the first screw 42, the second screw 43 and the developing sleeve 44 are driven continuously, and the developer surface within the developer container 41 is in a state assumable as a steady state. Actually, the extended portion E1 is formed so that a lower end portion 8*c*, which is an opposite edge in the thickness direction as the lower edge 8*b* of the inclined plane 81, is lower than a vertex position P2 of the blade portion 43*b* of the second screw 43.

As described, the developing apparatus 4A according to the present embodiment includes the extended portion E1 extended in a successively inclined manner with the inclined plane 81 at a position overlapped with the transfer portion 41*b* in the conveyance direction of the second screw 43. Therefore, the recovered developer having slid down the inclined plane 81 at the position of the transfer portion 41*b* and having reached the agitation chamber Ch2 is restricted from residing on the surface layer of the developer by the extended portion E1. In other words, the embodiment adopts a configuration where the recovered developer automatically sinks to the inner side of the developer at least temporarily in order to move to an opening portion of the transfer portion 41*b*. Therefore, along with the rotation of the second screw 43, the recovered developer is agitated and mixed with the surrounding developer, and the developer in the homogenized state is transferred to the development chamber Ch1. Thereby, the developing apparatus 4A can promote agitation of the developer recovered from the developing sleeve 44 at the position of the transfer portion 41*b*, and maintain the quality of the images.

Further, as illustrated in FIG. 6C, the second screw 43 is driven to rotate in a direction in which the blade portion 43*b* moves away from the development chamber Ch1 above the rotational axis, and the blade portion 43*b* approaches the development chamber Ch1 below the rotational axis, or in other words, in a clockwise direction in the drawing. Since the extended portion E1 is provided, the lower edge 8*b* of the inclined plane 81 is positioned between the partition portion 41*a* and the rotational axis of the second screw 43. Therefore, a large portion of the recovered developer having reached the surface layer of the developer via the extended portion E1 is expected to move in a manner bypassing the rotational axis along the direction of rotation of the second screw 43 and reach the transfer portion 41*b*. Thus, the agitation of the developer at the position of the transfer portion 41*b* can be promoted more effectively.

Comparative Experiment

Figure 7:
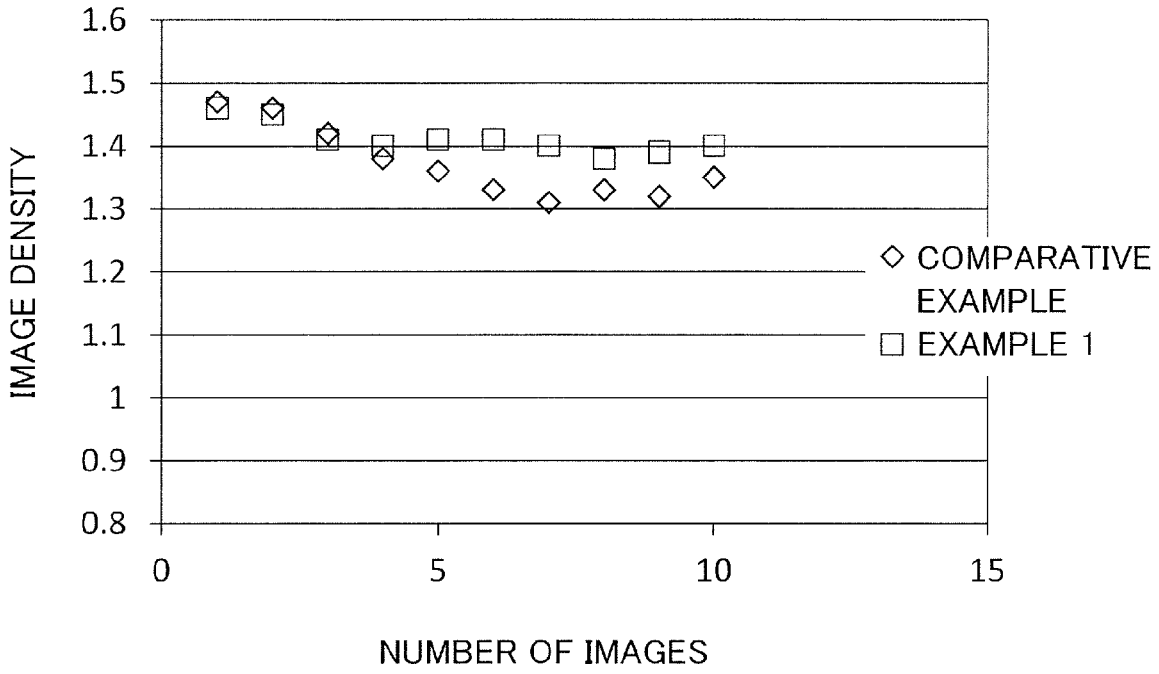
FIG. 7 is a graph illustrating a comparative experiment of the example according to the first embodiment and a comparative example.

FIG. 7 illustrates the result of a comparative experiment performed using an example (Example 1) of the developing apparatus 4A in which the configuration of the present embodiment is employed, and the developing apparatus 4Z of the comparative example. The comparative experiment was performed as follows: an image forming apparatus equipped with the developing apparatus 4A or the developing apparatus 4Z was prepared, and developer with a toner density (T/D) of 7% was stored in advance in each developer container 41. Then, an image forming operation where a plurality of solid painting images are successively formed was executed by each image forming apparatus. The density of image data input to the image forming apparatus was set so that a reflection density of the image on the first sheet is approximately 1.45 when measured using a spectral density meter manufactured by X-rite Inc. (X-rite 500 series). Then, the above-mentioned spectral density meter was used to measure the density of the image formed on the recording material P every time a recording material P was output from the image forming apparatus. The detection position of the spectral density meter was set to a position corresponding to the transfer portion 41*b* in the width direction of the recording material P, i.e., the width direction of the developing sleeve 44.

Under such condition, the densities of images formed using the developing apparatus 4A and the developing apparatus 4Z were compared. As illustrated in FIG. 7, when the developing apparatus 4Z of the comparative example was used, the image density, i.e., reflection density, was deteriorated along with the repeated image forming operation, and the image density was in a state transiting within a range of 1.30 to 1.35. On the other hand, when the developing apparatus 4A according to the present embodiment was used, the image density was somewhat deteriorated by repeating the image forming operation, but an image density, i.e., reflection density, of around 1.40 was maintained. Further, according to the comparative example, an unevenness of density where the image density is deteriorated at a position corresponding to the area around the transfer portion 41*b* had become noticeable from the fifth and subsequent images, while on the other hand, the deterioration of image density had been suppressed according to the present embodiment, and the unevenness of density of the image had been reduced.

Second Embodiment

Figure 8A:
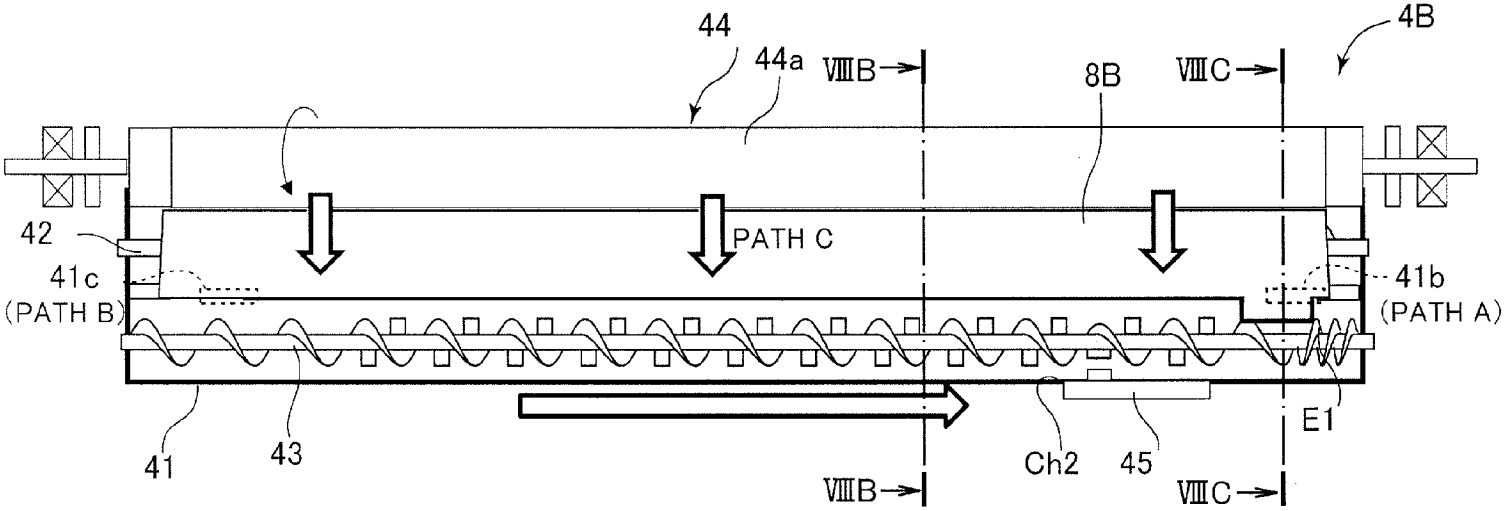
FIG. 8A is an upper view illustrating a developing apparatus according to the second embodiment.
Figure 8C:
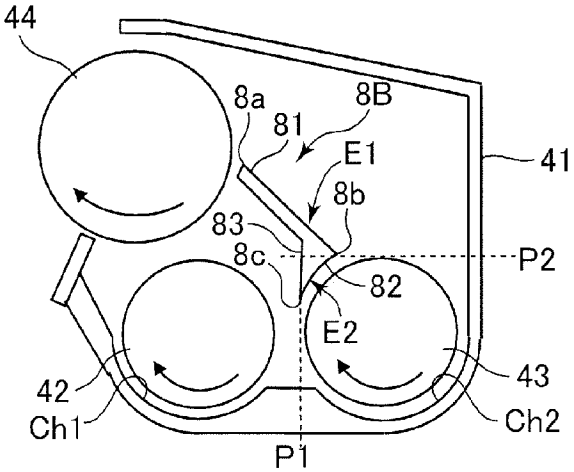
FIG. 8C is a cross-sectional view taken at another position illustrated in FIG. 8A.
Figure 8B:
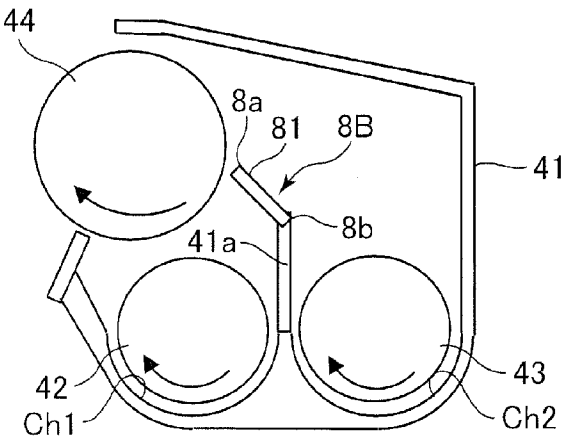
FIG. 8B is a cross-sectional view taken at a position illustrated in FIG. 8A.

Next, a developing apparatus 4B according to the second embodiment will be described with reference to FIGS. 8A through 8C. FIG. 8A is an upper view illustrating the developing apparatus 4B in a state where the top plate portion 41*t* of the developer container 41 is removed. FIG. 8B and FIG. 8C are cross-sectional views of the developing apparatus 4B respectively taken at position of line VIIIB-VIIIB and line VIIIC-VIIIC of FIG. 8A. This developing apparatus 4B constitutes a portion of the image forming unit composed similarly as the above-described image forming units PY through PK, and the elements are configured similarly as the first embodiment, except for the design of an inclined portion 8B. Therefore, the members having similar configurations and functions as the developing apparatus 4A according to the first embodiment are denoted with the same reference numbers, and descriptions thereof are omitted.

As illustrated in FIG. 8A, the developing apparatus 4B according to the present embodiment performs circulation conveyance of the developer stored in the developer container 41 between the development chamber Ch1 and the agitation chamber Ch2, similar to the above-described developing apparatus 4A. That is, the developer stored in the agitation chamber Ch2 is sent into the development chamber Ch1 via the transfer portion 41*b*, i.e., path A, and returned to the agitation chamber Ch2 via the transfer portion 41*c*, i.e., path B. Further, the developer borne on the developing sleeve 44 and used for development, i.e., recovered developer, is recovered into the agitation chamber Ch2 via the inclined portion 8B, i.e., path C.

As illustrated in FIG. 8C, the inclined portion 8B according to the present embodiment has an extended portion E1 arranged at a position overlapped with the transfer portion 41*b* in the direction of conveyance of the second screw 43, and a suspended portion E2 extending downward from the extended portion E1. When seen from the axial direction of the developing sleeve 44, the extended portion E1 is formed in a successively inclined manner with the inclined plane 81, and inclined downward from the side of the development chamber Ch1 toward the side of the agitation chamber Ch2. Further, the suspended portion E2 is formed to have a substantially triangular shape protruding downward with the extended portion E1 serving as one side of the triangle. The extended portion E1 and the suspended portion E2 are composed as a part of the inclined portion 8B formed integrally of synthetic resin, for example.

The shape of the suspended portion E2 will be described in detail. The suspended portion E2 is in an area sandwiched by a perpendicular plane 83 and an opposing plane 82 respectively connecting the lower end portion 8*c* of the inclined portion 8B and the extended portion E1. The perpendicular plane 83 spreads upward in an approximately perpendicular direction from the lower end portion 8*c* that is at an approximately equivalent horizontal position as the partition portion 41*a*, i.e., the agitation chamber-side wall surface position P1, when seen from the axial direction of the developing sleeve 44, and connects to a rear surface of the inclined plane 81, facing the development chamber Ch1. The opposing plane 82 spreads in an arced cross-sectional shape along the circumferential direction of the second screw 43 across the lower end portion 8*c* and the lower edge 8*b*, i.e., leading end portion, of the inclined plane 81, and opposes the blade portion 43*b* of the second screw 43 with a predetermined gap formed therebetween. A predetermined gap is set to such a value the developer entering the space between the opposing plane 82 and the second screw 43 is taken into the inner side of the rotation trajectory of the blade portion 43*b* by the rotation of the blade portion 43*b*.

The developing apparatus 4B formed as above can exert a similar effect as the developing apparatus 4A according to the first embodiment by providing the extended portion E1. That is, the recovered developer recovered from the developing sleeve 44 and having reached the surface layer of the developer in the agitation chamber Ch2 at the position of the transfer portion 41*b* is regulated by the extended portion E1 from moving to the development chamber Ch1 while remaining on the surface layer. Thereby, the agitation of the recovered developer and the surrounding developer is promoted, and image defects such as unevenness of density can be reduced.

In addition, the developing apparatus 4B according to the present embodiment realizes the following functions by providing the suspended portion E2. That is, according to the configuration of the first embodiment, the extended portion E1 is composed of a plate member having a relatively small thickness, so that it may be possible for a portion of the recovered developer having reached the surface layer of the developer to pass the lower side of the extended portion and move to the development chamber Ch1. On the other hand, according to the developing apparatus 4B of the present embodiment, the recovered developer having reached the surface layer of the developer is reliably restricted by the suspended portion E2 extending below the extended portion E1 from passing through the lower end portion 8*c* of the inclined portion 8B. Since the opposing plane 82 of the suspended portion E2 is formed along a circumferential direction of the second screw 43, the developer entering the narrow space between the opposing plane 82 and the second screw 43 is drawn to the inner side of the rotation trajectory of the blade portion 43*b* by the rotation of the blade portion 43*b*. Thereby, the agitation of the developer recovered from the developing sleeve 44 at the position of the transfer portion 41*b* can be promoted further, and the image defects such as unevenness of density can be reduced even further.

Comparative Experiment

Figure 9:
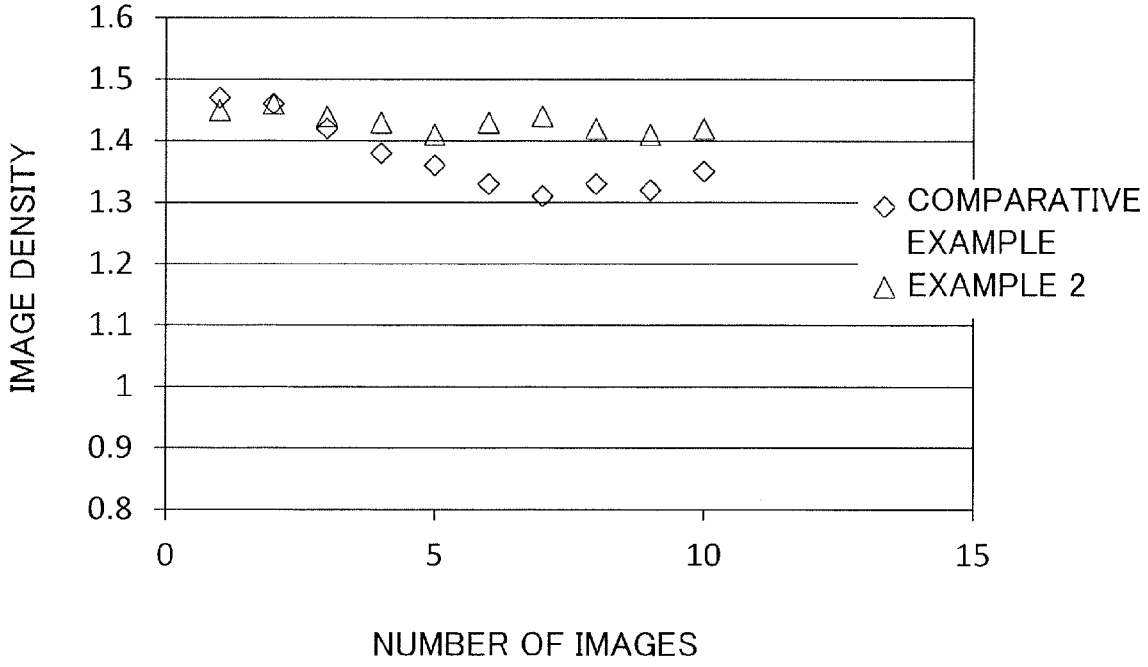
FIG. 9 is a graph illustrating a result of a comparative experiment of the example according to the second embodiment and the comparative example.

FIG. 9 illustrates the result of a comparative experiment performed using an example (Example 2) of the developing apparatus 4B in which the configuration of the present embodiment is employed, and the developing apparatus 4Z of the comparative example. The method of the comparative experiment is similar to the method according to the first embodiment. Under such condition, the densities of images formed using the developing apparatus 4B and the developing apparatus 4Z were compared.

As illustrated in FIG. 9, when the developing apparatus 4Z of the comparative example was used, the image density, i.e., reflection density, was deteriorated along with the repeated image forming operation, and the image density was in a state transiting within a range of 1.30 to 1.35. On the other hand, when the developing apparatus 4B according to the present embodiment was used, the image density was somewhat deteriorated by repeating the image forming operation, but an image density, i.e., reflection density, of around 1.40 to 1.45 was maintained. Further, according to the comparative example, an unevenness of density where the image density is deteriorated at a position corresponding to the area around the transfer portion 41*b* had become noticeable from the fifth and subsequent images, while on the other hand, the deterioration of image density had been suppressed according to the present embodiment, and the unevenness of density of the image had been reduced.

Third Embodiment

Figure 10A:
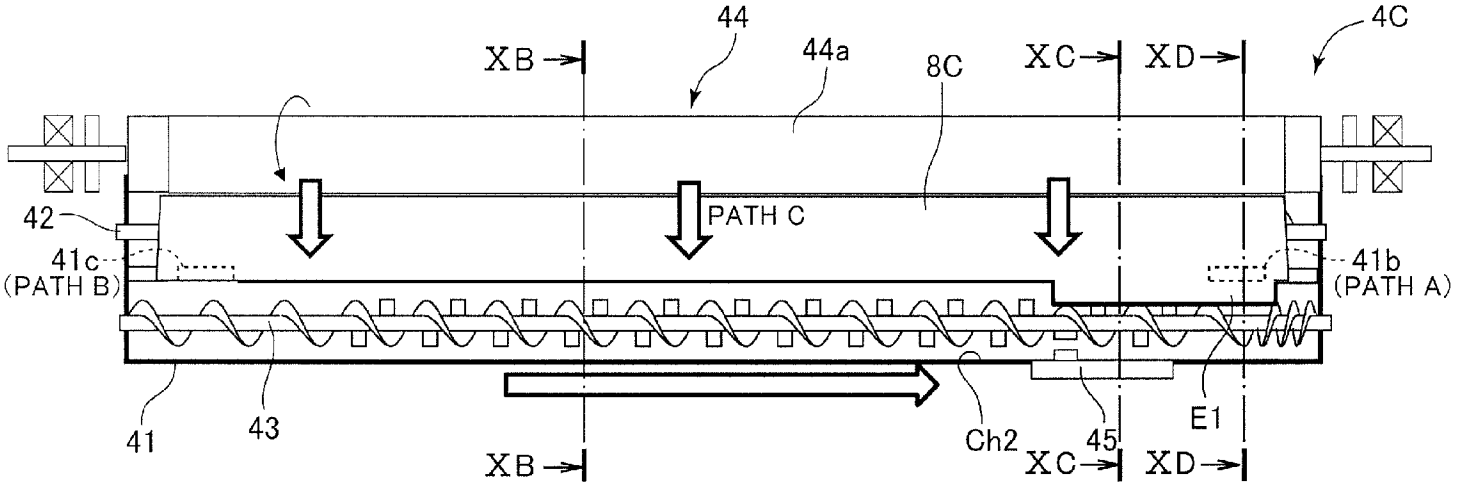
FIG. 10A is an upper view illustrating a developing apparatus according to the third embodiment.
Figure 10D:
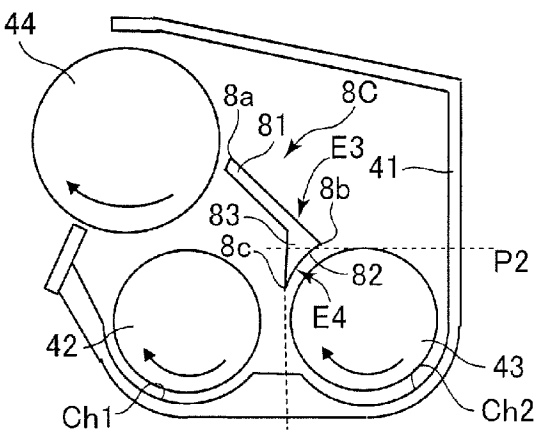
FIG. 10D is a cross-sectional view taken at still another position illustrated in FIG. 10A.
Figure 10C:
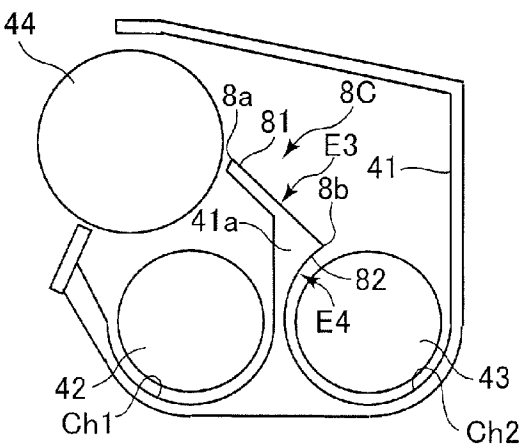
FIG. 10C is a cross-sectional view taken at another position illustrated in FIG. 10A.
Figure 10B:
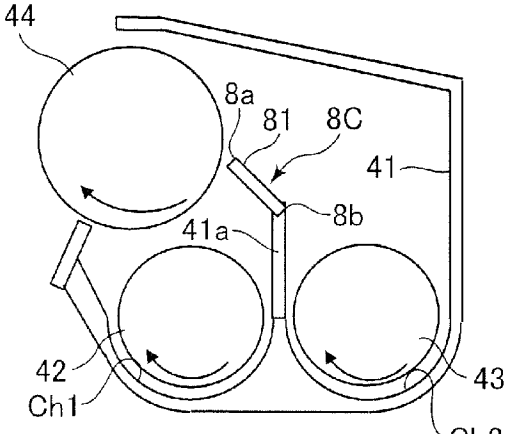
FIG. 10B is a cross-sectional view taken at a position illustrated in FIG. 10A.

Next, a developing apparatus 4C according to the third embodiment will be described with reference to FIGS. 10A, 10B, 10C, and 10D. FIG. 10A is an upper view illustrating the developing apparatus 4C in a state where the top plate portion 41*t* of the developer container 41 is removed. FIGS. 10B, 10C and 10D are cross-sectional views of the developing apparatus 4C respectively taken at position of lines XB-XB, XC-XC and XD-XD of FIG. 10A. This developing apparatus 4C constitutes a portion of the image forming unit composed similarly as the above-described image forming units PY through PK, and the elements are configured similarly as the first and second embodiments, except for the design of an inclined portion 8C. Therefore, the members having similar configurations and functions as the developing apparatus 4A according to the first and second embodiments are denoted with the same reference numbers, and descriptions thereof are omitted.

As illustrated in FIG. 10A, the developing apparatus 4C according to the present embodiment performs circulation conveyance of the developer stored in the developer container 41 between the development chamber Ch1 and the agitation chamber Ch2, similar to the above-described developing apparatuses 4A and 4B. That is, the developer stored in the agitation chamber Ch2 is sent into the development chamber Ch1 via the transfer portion 41*b*, i.e., path A, and returned to the agitation chamber Ch2 via the transfer portion 41*c*, i.e., path B. Further, the developer borne on the developing sleeve 44 and used for development is recovered into the agitation chamber Ch2 via the inclined portion 8B, i.e., path C.

As illustrated in FIG. 10D, the inclined portion 8C according to the present embodiment has an extended portion E3 and a suspended portion E4 arranged at a position overlapped with the transfer portion 41*b* in the direction of conveyance of the second screw 43. The extended portion E3 and the suspended portion E4 are formed to have a similar shape as the extended portion E1 and the suspended portion E2 of the inclined portion 8B according to the second embodiment at the position overlapped with the transfer portion 41*b*. However, unlike the second embodiment, the extended portion E3 and the suspended portion E4 are extended further upstream of the transfer portion 41*b* in the direction of conveyance of the second screw 43.

That is, as illustrated in FIG. 10C, the extended portion E3 is formed to protrude further from the partition portion 41*a* toward the side of the agitation chamber Ch2 at the upstream position of the transfer portion 41*b*. Further, the suspended portion E4 is formed integrally with the partition portion 41*a*, and the opposing plane 82 formed to have an arced cross-section is opposed to the second screw 43 with the above-mentioned predetermined gap formed therebetween. Therefore, a configuration is realized where, at the upstream position of the transfer portion 41*b*, an area having a triangular shape, i.e., delta shape, surrounded by the extended portion E3, the partition portion 41*a* and the rotation trajectory of the second screw 43 is occupied by the suspended portion E4.

As illustrated in FIG. 10A, the extended portion E3 and the suspended portion E4 are extended for a length equal to or greater than a pitch width of the blade portion 43*b* (in the illustrated example, a length corresponding to two pitches) to the upstream side from the opening of the transfer portion 41*b* in the direction of conveyance of the second screw 43. As illustrated in FIG. 10B, the extended portion E3 and the suspended portion E4 are not formed at a position further upstream from the position corresponding to two pitches of the transfer portion 41*b*, and the inclined plane 81 is connected to the partition portion 41*a* at the lower edge 8*b*.

The developing apparatus 4C configured as described above can achieve similar effects as the developing apparatuses 4A and 4B, by providing the extended portion E3 and the suspended portion E4. That is, the recovered developer recovered from the developing sleeve 44 at the position of the transfer portion 41*b* and reaching the surface layer of the developer in the agitation chamber Ch2 is restricted by the extended portion E3 from moving to the development chamber Ch1 while remaining on the surface layer. Thus, it becomes possible to promote agitation of the developer including the recovered developer, and reduce unevenness of density and other image defects. Furthermore, since the suspended portion E4 is provided, the developer entering a space between the opposing plane 82 and the second screw 43 at the position of the transfer portion 41*b* is drawn to the inner side of the rotation trajectory of the blade portion 43*b* along with the rotation of the blade portion 43*b*. Thereby, the agitation of the developer at the position of the transfer portion 41*b* can be promoted further, and unevenness of density and other image defects can be reduced even further.

According to the configuration where the extended portion E1 and the suspended portion E2 are formed to have a substantially equivalent width as the transfer portion 41*b* as in the second embodiment, it may be possible for the recovered developer to move to the development chamber Ch1 through a clearance created between the suspended portion E2 and the partition portion 41*a*, for example. This is due to the fact that agitation of the developer is inactive at the outer side of the rotation trajectory of the second screw 43, while the developer is gradually conveyed toward the direction of conveyance of the second screw. The recovered developer having reached the above-described delta shaped area at the position upstream of the transfer portion 41*b* moves so as to float on the surface layer of the developer, reach the clearance between the suspended portion E2 and the partition portion 41*a*, and flow into the development chamber Ch1.

On the other hand, according to the developing apparatus 4C of the present embodiment, the extended portion E3 and the suspended portion E4 are extended to the upstream side of the transfer portion 41*b*, and the delta shaped area occupies a space corresponding to a length of two pitches of the blade portion 43*b*. Therefore, the recovered developer recovered into the agitation chamber Ch2 in the area upstream of the transfer portion 41*b* and in a range where the extended portion E3 is provided is restricted by the suspended portion E4 from moving into the development chamber Ch1 while remaining on the surface layer of the developer. As for the recovered developer recovered into the agitation chamber Ch2 at a position further upstream of the extended portion E3, even if the developer enters a narrow space between the opposing plane 82 and the rotation trajectory of the blade portion 43*b*, the developer is drawn into the rotation trajectory of the blade portion 43*b* and agitated before reaching the transfer portion 41*b*. Thereby, the present embodiment enables to promote further agitation of the developer and to even further reduce unevenness of density and other image defects compared to the first and second embodiments.

Comparative Experiment

Figure 11:
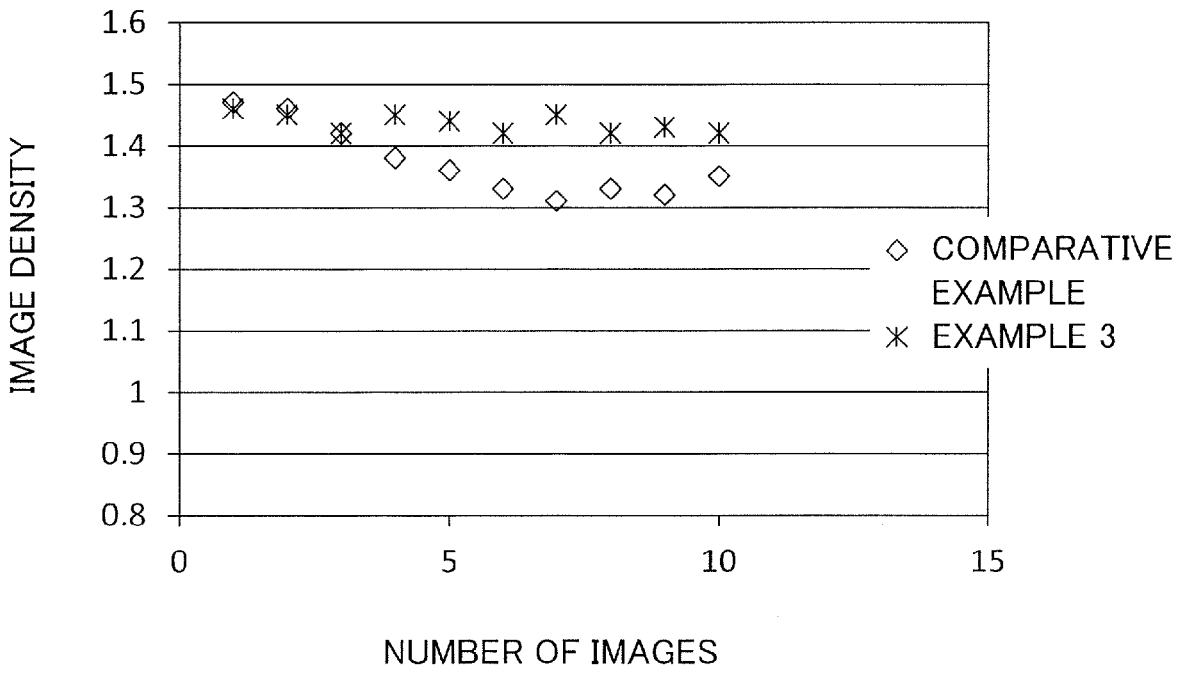
FIG. 11 is a graph illustrating a result of a comparative experiment of the example according to the third embodiment and the comparative example.

FIG. 11 illustrates the result of a comparative experiment performed using an example (Example 3) of the developing apparatus 4C in which the configuration of the present embodiment is employed, and the developing apparatus 4Z of the comparative example. The method of the comparative experiment is similar to the method according to the first and second embodiments. Under such condition, the densities of images formed using the developing apparatus 4C and the developing apparatus 4Z were compared.

As illustrated in FIG. 11, when the developing apparatus 4Z of the comparative example was used, the image density, i.e., reflection density, was deteriorated along with the repeated image forming operation, and the image density was in a state transiting within a range of 1.30 to 1.35. On the other hand, when the developing apparatus 4C according to the present embodiment was used, the image density was somewhat deteriorated by repeating the image forming operation, but an image density, i.e., reflection density, of around 1.40 to 1.45 was maintained. Further, according to the comparative example, an unevenness of density where the image density is deteriorated at a position corresponding to the area around the transfer portion 41*b* had become noticeable from the fifth and subsequent images, while on the other hand, the deterioration of image density had been suppressed according to the present embodiment, and the unevenness of density of the image had been reduced.

Other Embodiments

According to the above-described first to third embodiments, the inclination angle of the extended portions E1 and E3 with respect to the horizontal plane is set equal to the inclination angle of the inclined plane 81, but the shape of the extended portion is not restricted thereto. For example, the inclination angle of a portion or a whole of the extended portion can be set to a different angle as the inclination angle of the inclined plane 81. Moreover, the extended portion is not restricted to the configuration where the upper surface is formed as a flat plane, and the upper surface can be formed as a curved plane with an arced cross-sectional shape, for example. In conclusion, the extended portion E1 should be inclined in a successive manner with the inclined plane 81 so that the recovered developer will slide down the surface in continuation from the inclined plane 81.

Further, the developing apparatuses 4A, 4B and 4C according to the first to third embodiments are configured so that the development chamber Ch1 and the agitation chamber Ch2 are arranged approximately horizontally and in parallel, but it is also possible to arrange the agitation chamber Ch2 in a downwardly inclined manner toward the downstream side in the direction of conveyance of the developer. Even according to such configuration, the present technique can be applied as long as the configuration includes a recovery member recovering the developer into the agitation chamber Ch2 through the upper portion of the partition portion extending in the horizontal direction. It is noted that the partition portion is not restricted to a design spreading perpendicularly with respect to the horizontal plane.

Moreover, the conveyance member arranged in the agitation chamber, i.e., second chamber, is not restricted to a screw having the blade portion 43*b*, as in the above-described second screw 43, and it can be a rotary member in which paddle-shaped agitation projections, i.e., agitation ribs, are formed at the position of the transfer portion 41*b*. Even according to such case, similar effects as the respective embodiments can be achieved by providing extended portions E1 and E3 (and suspended portions E2 and E4) similar to the first through third embodiments described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-227261, filed on Nov. 20, 2015, which is hereby incorporated by reference herein in its entirety.

What is claimed is:

1. A developing apparatus comprising:

a developer bearing member configured to rotate, bear developer including toner and carrier, and convey the developer to a developing region where the developer bearing member faces an image bearing member;

a first chamber arranged below a rotation axis of the developer bearing member in a gravity direction and configured to supply the developer to the developer bearing member;

a second chamber facing the developer bearing member and configured to collect the developer having passed through the developing region;

a partition portion arranged to separate the first chamber and the second chamber from each other;

a first communicating portion configured to permit the developer in the first chamber to communicate from the first chamber to the second chamber;

a second communicating portion configured to permit the developer in the second chamber to communicate from the second chamber to the first chamber;

a first conveyance screw arranged in the first chamber and configured to convey the developer in the first chamber in a first direction;

a second conveyance screw arranged in the second chamber configured to convey the developer in the second chamber in a second direction opposite to the first direction; and a developer guiding portion arranged on the partition portion and facing the developer bearing member, the developer guiding portion being configured to guide the developer having passed through the developing region from the developer bearing member to the second chamber, wherein the developer guiding portion includes a first guiding portion arranged in an area between the first communicating portion and the second communicating portion in the second direction, and a second guiding portion arranged above the second communicating portion, the second guiding portion covering an entire area of the second communicating portion in the second direction when viewed in the gravity direction, and wherein when the developing apparatus is viewed in a cross section perpendicular to the rotation axis of the developer bearing member, one end portion of the second guiding portion is arranged above an upper end of the partition portion in the gravity direction while leaving a clearance between the second guiding portion and the developer bearing member, and the other end portion of the second guiding portion is arranged above a rotation axis of the second conveyance screw in the gravity direction and below an uppermost portion of the second conveyance screw in the gravity direction while leaving a clearance between the second guiding portion and the second conveyance screw.

2. The developing apparatus according to claim 1, wherein when the developing apparatus is viewed in a cross section perpendicular to the rotation axis of the developer bearing member, the other end portion of the second guiding portion is arranged at a position, in a direction perpendicular to the gravity direction, between a closest part of the second conveyance screw to the second communicating portion and the rotation axis of the second conveyance screw.

3. The developing apparatus according to claim 1, wherein the first guiding portion includes a third guiding portion arranged over an entire region between a position upstream of an upstream end of the second communicating portion at least by a length corresponding to one pitch of a blade portion of the second conveyance screw in the second conveyance direction to a position of the upstream end of the second communicating portion in the second conveyance direction, and wherein when the developing apparatus is viewed in a cross section perpendicular to the rotation axis of the developer bearing member, one end portion of the third guiding portion is arranged above the upper end of the partition portion in the gravity direction while leaving a clearance between the third guiding portion and the developer bearing member, and the other end portion of the third guiding portion is arranged above the rotation axis of the second conveyance screw in the gravity direction and below the uppermost portion of the second conveyance screw in the gravity direction while leaving a clearance between the third guiding portion and the second conveyance screw.

4. The developing apparatus according to claim 1, wherein the developer guiding portion is integrally formed with the partition portion.

5. The developing apparatus according to claim 1, wherein when the developing apparatus is viewed in a cross section perpendicular to the rotation axis of the developer bearing member, an opposing surface of the second guiding portion opposing the second conveyance screw is formed into a circular arc shape along an outer circumference of the second conveyance screw.

* * * * *